US005321756A

United States Patent [19]

Patterson, Jr. et al.

[11] Patent Number: 5,321,756

[45] Date of Patent: Jun. 14, 1994

[54] LOUDSPEAKER SYSTEM WITH SONICALLY POWERED DRIVERS AND CENTERED FEEDBACK LOUDSPEAKER CONNECTED THERETO

[76] Inventors: James K. Patterson, Jr.; Robert L. Patterson, both of 5059 Osceola, Denver, Colo. 80212

[21] Appl. No.: 869,143

[22] Filed: Apr. 14, 1992

Related U.S. Application Data

[63] Continuation-in-part of Ser. No. 498,286, Mar. 23, 1990, abandoned.

[51] Int. Cl.[5] ..... H04R 5/02

[52] U.S. Cl. ..... 381/24; 381/89; 381/88; 381/205

[58] Field of Search ..... 381/24, 28, 89, 99, 381/100, 188, 205; 181/163, 191

[56] References Cited

U.S. PATENT DOCUMENTS

| | | | |
|---|---|---|---|
| D. 210,382 | 3/1965 | Worth . | |
| D. 222,477 | 10/1971 | Wada et al. | D14/214 |
| D. 226,567 | 3/1973 | Sioles | D14/212 |
| D. 242,259 | 11/1976 | Babb et al. | D14/214 |
| D. 270,052 | 8/1983 | Weiman | D14/211 |
| 2,993,091 | 7/1961 | Guss . | |
| 3,165,587 | 1/1965 | Alderson . | |
| 3,688,864 | 9/1972 | Guss . | |
| 3,818,138 | 6/1974 | Sperrazza, Jr. . | |
| 3,867,996 | 2/1975 | Lou . | |
| 3,952,159 | 4/1976 | Schott . | |
| 4,031,318 | 6/1977 | Pitre . | |
| 4,134,471 | 1/1979 | Queen . | |
| 4,146,745 | 3/1979 | Froeschle et al. . | |
| 4,181,819 | 1/1980 | Cammack . | |
| 4,201,274 | 5/1980 | Carlton . | |
| 4,224,469 | 9/1980 | Karson . | |
| 4,284,166 | 8/1981 | Gale . | |
| 4,289,929 | 9/1981 | Hathaway . | |
| 4,298,087 | 11/1981 | Launay | 181/156 |
| 4,332,986 | 6/1982 | Butler . | |
| 4,350,847 | 9/1982 | Polk | 381/24 |
| 4,624,337 | 11/1986 | Shavers . | |
| 4,635,748 | 1/1987 | Paulson | 181/145 |
| 4,712,247 | 12/1987 | Swarte | 381/96 |
| 4,932,060 | 6/1990 | Schreiber | 381/24 |
| 5,150,417 | 9/1992 | Stahl | 181/156 |
| 5,181,247 | 1/1993 | Holl | 381/24 |

FOREIGN PATENT DOCUMENTS 57-55692A 4/1982 Japan .

OTHER PUBLICATIONS

AudioVideo International, Jun. 1985, p. 44, Top-Dahlquist model DQM-9 compact speaker system.

Stereo Review, Aug. 1986, p. 19, Top left-Meridian model M30 speaker.

*Primary Examiner*—Forester W. Isen

*Attorney, Agent, or Firm*—Gregg I. Anderson

[57] ABSTRACT

A stereophonic loudspeaker system which includes at least two channel loudspeakers and a centrally located feedback control loudspeaker. Each channel loudspeaker incorporates an electrically driven low frequency electrosonic transducer and a sonically driven electrosonic transducer sonically coupled together to form a sonic oscillator. The sonically driven transducer responds to sound and sonic vibrations produced by the electrically driven transducer to produce sounds and an electrical output signal. The feedback control amplifier includes a plurality of electrosonic transducers interconnected sonically and electrically. The transducers of the feedback control loudspeaker respond to the electrical signals from the sonically driven transducers of the channel loudspeakers to interactively enhance the production of aurally pleasing low frequency sound from the loudspeaker system.

32 Claims, 5 Drawing Sheets

LOUDSPEAKER SYSTEM WITH SONICALLY POWERED DRIVERS AND CENTERED FEEDBACK LOUDSPEAKER CONNECTED THERETO

CROSS-REFERENCE TO RELATED APPLICATION

The present application is a continuation-in-part of U.S. patent application Ser. No. 07/498,286 filed Mar. 23, 1990 for Sonic Oscillator, now abandoned.

BACKGROUND OF THE INVENTION

1. Field Of The Invention

The present invention relates to loudspeaker systems for sound reproduction. More particularly, the present invention relates to stereophonic loudspeaker systems having enhanced bass response.

2. Description Of The Prior Art

The art of sound reproduction involves capturing sounds such as music, processing the sounds, and reproducing the captured sounds in aural form. Processing may be primarily amplification, as in a public address system, or it may also include recording the sound in a fixed form, such as a magnetic tape, grooved disc or optically read disc and playing back the recorded sound from the fixed form. Processing may also include broadcast and reception of a signal representing the sound by radio or television.

In the art of sound reproduction, each step of the processes of capturing, processing and reproducing the captured sounds results in a loss in the accuracy of the reproduction of the sound. This accuracy of sound reproduction may be measured by various parameters, but is referred to generally as "fidelity." The development of the modern art of sound reproduction has been spurred by a continuing quest for increasing levels of sound fidelity coupled with a quest for aurally pleasing sound reproduction.

One key element in sound reproduction is a loudspeaker system that converts electrical signals representative of the sound to be produced into aurally perceptible sound. The loudspeaker system is particularly important in producing high fidelity and aurally pleasing sound as it is typically the final element in the sound reproduction system. A loudspeaker system typically includes one or more loudspeaker enclosures, each loudspeaker enclosure having one or more electrosonic transducers, or "drivers", mounted in the enclosure.

A limiting factor in the ability of a loudspeaker system to contribute to high fidelity and aurally pleasing sound reproduction is its ability to produce low frequency sounds pleasingly. Typically the ability of a loudspeaker system to reproduce low frequency sounds pleasingly is determined in large part by the physical size of the drivers and the enclosure. Generally, larger drivers and enclosures produce more pleasing low frequency sounds than smaller drivers and enclosures. In practical loudspeaker system design, however, the desirability of large drivers and enclosures for pleasing low frequency sound reproduction is balanced by a desirability of smaller drivers and enclosures for use in the limited space available in homes, automobiles, and other places where loudspeaker systems are typically used. The ability of the loudspeaker system to produce pleasing low frequency sounds is further affected by the size, geometry, materials and other characteristics of the room or other place in which the loudspeaker system is used.

Many loudspeaker designs have been proposed to improve the fidelity and aurally pleasing qualities of sound reproduction within loudspeaker systems of a practical physical size. Angled front baffles are seen in U.S. Des. No. 210,382 to T. Lane, and in U.S. Des. No. 222,477 to H. Wada, et al. Ducted ports are seen in U.S. Pat. No. 3,952,159 to W. Schott, and in U.S. Pat. No. 4,688,864 to R. Guss. Ports which perform structural as well as acoustic functions are seen in U.S. Pat. No. 4,201,274 to C. Carlton. Still another port or vent for use with bass range loudspeakers is seen in U.S. Pat. No. 4,284,166 to G. Gale.

Bass range drivers mounted in a bottom wall of a loudspeaker enclosure rather than in a front baffle, and which are electrically driven by an amplifier are seen in Guss and in U.S. Pat. No. 3,867,996 to N. Lou, as well as in U.S. Pat. No. 4,134,471 to D. Queen. None of the prior art mounts a bass range driver complete with all of its electromagnetic components in an opening of a loudspeaker enclosure without connecting the driver to the amplifier electrical output. None of the prior art patents, the commercial devices available, or the literature on the construction of loudspeaker enclosures appear to suggest any use of openings or vents of different types together in a loudspeaker enclosure.

Duct tubes in place of simple openings are also known in the construction of bass reflex loudspeakers. Such tubes are located entirely within the enclosure or backchamber of bass range loudspeakers. A bass range duct tube providing air or sound communication between the backchamber of a loudspeaker enclosure to an opening in a loudspeaker mounting baffle plate does not appear to be known. Further, passing the tube through a second backchamber or subenclosure which contains and isolates higher mid and high frequency range loudspeakers does not appear to be known in the prior art.

Two divergent means of reducing enclosure volume while maintaining relatively high levels of acoustic output at low frequency may be seen in R. Guss, U.S. Pat. No. 2,993,091. The Guss device involves multiple loudspeakers arranged so as to physically increase the acoustic drag on each diaphragm as a function of the movement of the multiple diaphragms of the several loudspeakers. In addition to Guss, U.S. Pat. No. 4,146,745 to T. Froeshle, et al., employs multiple loudspeakers sharing common vent tubes. In T. Froeshle the diaphragms of the loudspeaker do not share the enclosure backchamber. The loudspeakers are energized by the amplifier electrical output during operation.

A third attempt to reduce enclosure volume is cited by R. Guss as background to his invention. This invention employs a dynamic cone driver to damp the motion of the diaphragm of a similar loudspeaker by locating it within the enclosure, closely placed behind the driver to be damped. This damping driver is neither electrically energized, nor exposed to the ambient atmosphere surrounding the device. Rather the loudspeaker is sealed within the enclosures.

Other references of, general interest include U.S. Pat. No. 3,688,864 to T. Froeschle, et al. and U.S. Pat. No. 4,146,745 to R. Guss.

It is against this background that the bass-enhancing loudspeaker system of the present invention developed.

OBJECTS AND SUMMARY OF THE INVENTION

An object of the present invention is to provide a sonic oscillator comprising a loudspeaker which produces aurally perceptible sounds and sonic vibrations as a substantially direct function of an electrical input signal and which simultaneously generates an electrical output signal as a substantially direct function of the sounds and sonic vibrations produced by the loudspeaker and as an indirect function of the electrical input signal.

In accordance with this object of the invention, the loudspeaker includes a loudspeaker enclosure. At least one electrically actuated electrosonic transducer, or "driver," responsive to electrical signals to produce low frequency sounds and sonic vibrations, referred to herein as a "woofer," is mounted in an opening in the enclosure. Additional woofers and other drivers may be mounted in the enclosure. The woofer is electrically connected to an amplifier to receive the electrical input signal. A sonically actuated driver, referred to herein as the "sonic driver," of a type adapted to produce low frequency sounds, is additionally mounted in the enclosure, but is not electrically connected to the amplifier. The woofer responds to the electrical input signal, sound being projected out of the loudspeaker and sound and other sonic vibrations being projected into the enclosure. The sonic driver is responsive to the sound and sonic vibrations within the enclosure to generate the electrical output signal.

Further in accordance with this object of the invention the sonic driver is mounted into an opening in the enclosure of the loudspeaker. Sound generated by the woofer and the sonic driver are heard simultaneously by a listener. This is accomplished, in part, by forming a vent in the enclosure and by the mounting of the woofer and the sonic drivers in openings in the enclosure.

Still further in accordance with this object of the invention the sonic driver is mounted in a downwardly-facing orientation, facing a reflective base plate located a predetermined distance from the sonic driver. The predetermined distance is selected so that sound produced by the downwardly-facing sonic driver is reflected from the base plate in a manner that enhances the pleasing qualities of the sound produced by the loudspeaker.

Further still in accordance with this object of the invention the woofer and sonic driver are arranged in a pre-determined orientation with respect to each other. The woofer is located in a generally frontwardly-facing orientation at a predetermined angle from vertical by angling a top of a mounting face of the enclosure away from the listener. This angle generates sound waves upwardly from horizontal, reducing reflection from the floor or other surface upon which the loudspeaker rests and facilitates aligning the woofer and sonic driver for substantially in-phase operation.

Still further yet in accordance with this object of the invention the vent in the enclosure includes a rigid tube which passes through a mass mounted within the enclosure. The tube is tuned at a frequency approximating the frequency at which the electrical and sonic drivers will resonate in free air. Tuning is accomplished by varying the volume and cross-sectional area of the tube to allow the air contained therein to easily move according to sound waves produced by the electrical and sonic drivers within the enclosure.

It is a further related object of the invention to provide a stereophonic loudspeaker system with an electrically and sonically interrelated network responsive to, and operative on, the electrical output signals generated by the loudspeakers.

In accordance with this object of the invention the output signals generated from the sonic drivers of at least two of the loudspeakers are connected to a centrally located feedback control loudspeaker. The feedback control loudspeaker includes a plurality feedback drivers which are connected by conductors in a predetermined network connection to the sonic drivers of the loudspeakers. The feedback drivers of the feedback device are driven by the electrical output of the sonic drivers.

Further in accordance with this object of the invention the feedback drivers are sonically interconnected through a duct of the feedback control loudspeaker.

For reasons not completely understood, the combination of features of the present invention result in a loudspeaker system producing a sound that is perceived by a listener as being more realistic and pleasing and is further perceived by the listener as having an enhanced low frequency on bass response.

Other aspects, features and details of the present invention can be more completely understood by reference to the following detailed description of a preferred embodiment, taken in conjunction with the drawings, and from the appended claims.

BRIEF DESCRIPTIONS OF THE DRAWINGS

DESCRIPTION OF THE PREFERRED EMBODIMENT

Figure 1:
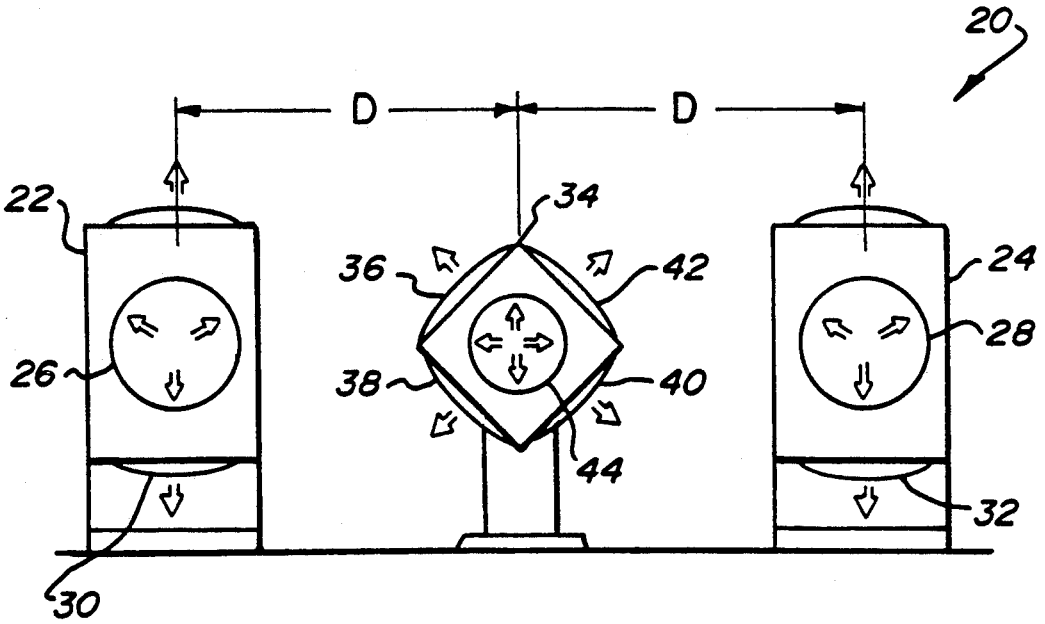
FIG. 1 is an elevational view of the bass-enhancing loudspeaker system of the present invention incorporating channel loudspeakers connected to a feedback control loudspeaker.
Figure 3:
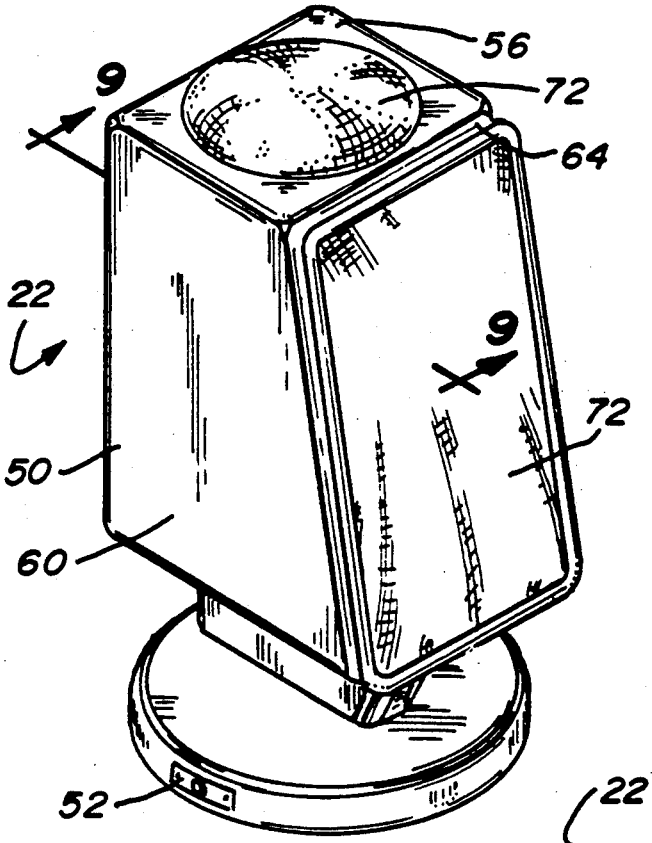
FIG. 3 is a perspective view of the channel loudspeaker shown in FIG. 1.
Figure 7:
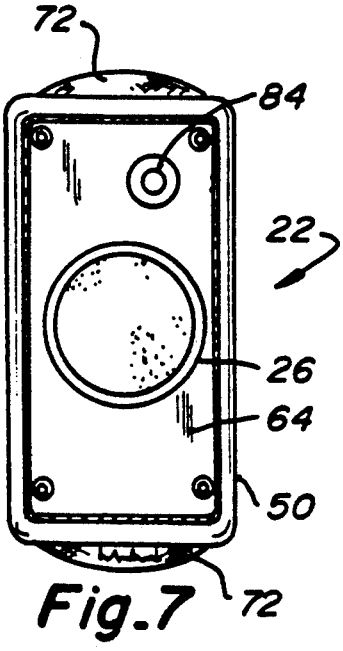
FIG. 7 is a fragmentary front elevational view of the loudspeaker taken along line 7—7 in FIG. 4.
Figure 5:
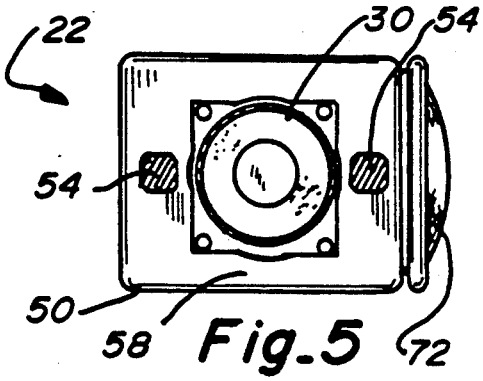
FIG. 5 is a sectional view of the channel loudspeaker taken along line 5—5 of FIG. 4.
Figure 4:
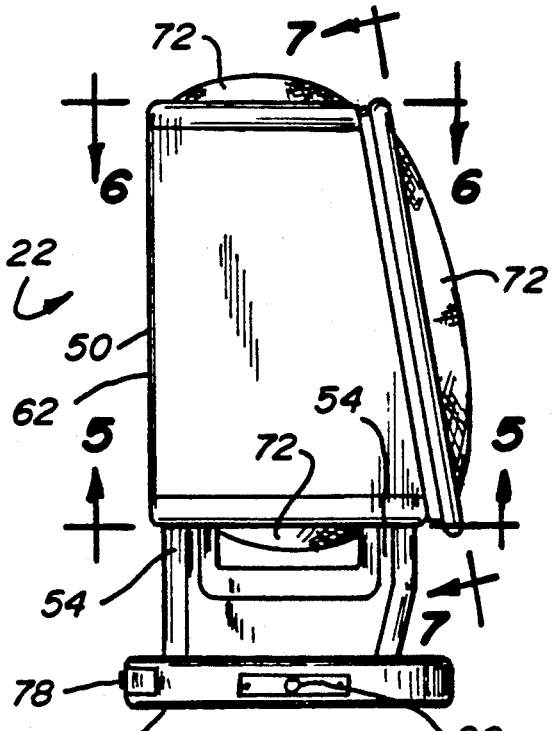
FIG. 4 is a side elevational view of the channel loudspeaker shown in FIG. 1.
Figure 6:
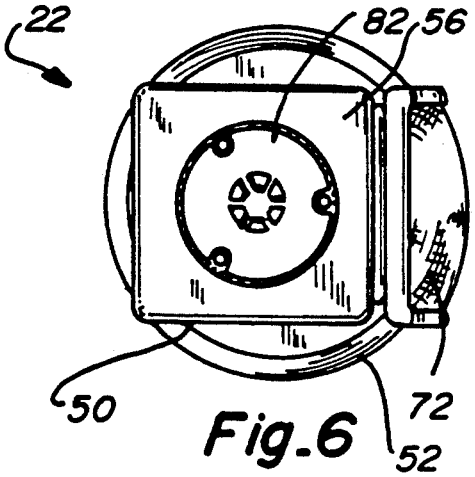
FIG. 6 is a top plan view of the channel loudspeaker taken along line 6—6 in FIG. 4.
Figure 8:
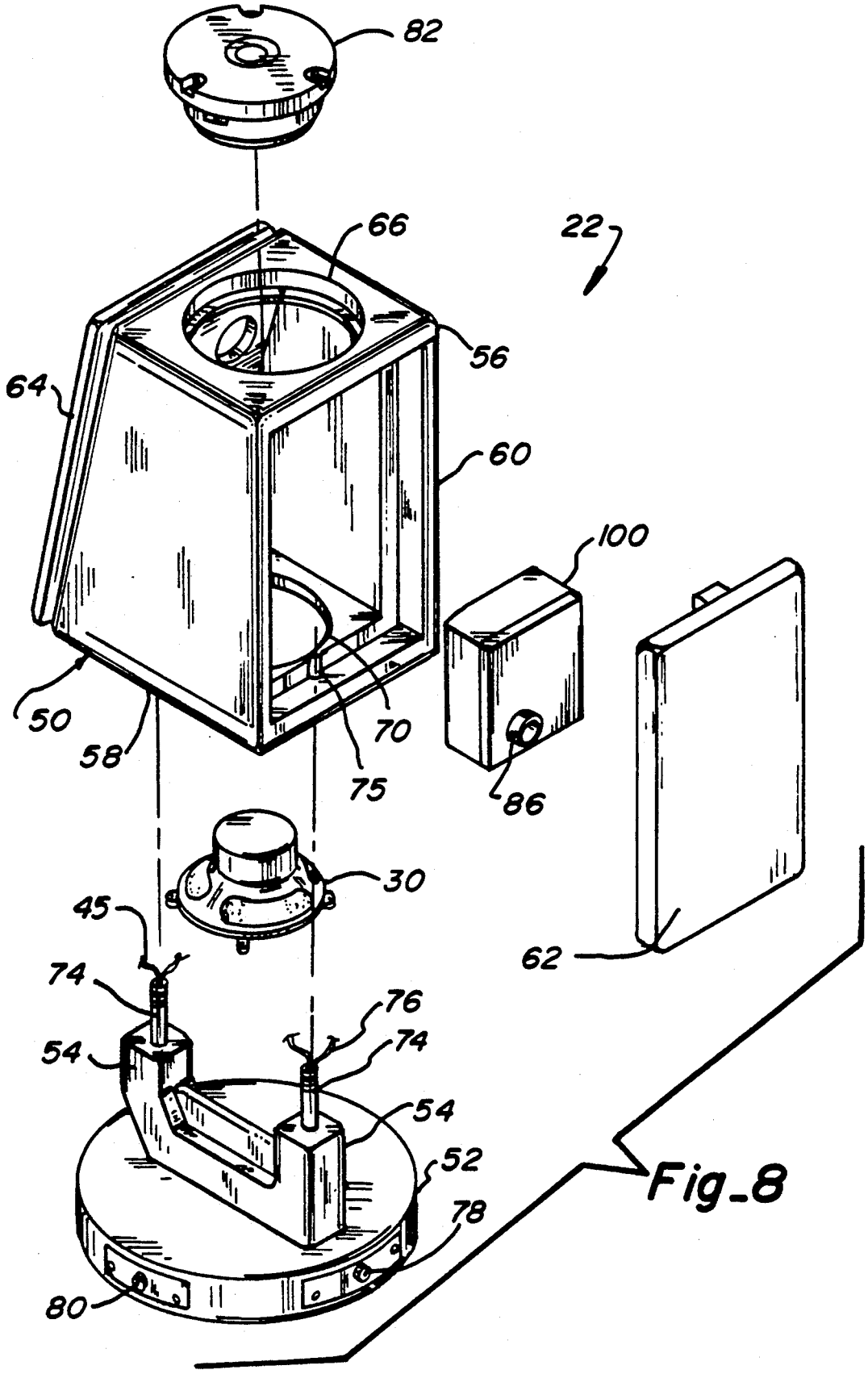
FIG. 8 is an exploded perspective view of the channel loudspeaker shown in FIG. 1.

A presently preferred embodiment of a stereophonic bass-enhancing loudspeaker system of the present invention is described initially by reference to FIG. 1. The bass-enhancing loudspeaker system 20 includes a left channel loudspeaker 22 and a right channel loudspeaker 24. Each of the left and right channel loudspeakers 22 and 24 are electrically connected to receive an electrical signal from a corresponding output channel of a stereophonic amplifier, receiver or other processing equipment (not shown), referred to herein generally as the amplifier.

Each channel loudspeaker 22 and 24 includes a plurality of electrosonic transducers, referred to herein as "drivers," which are adapted to convert electrical signals to aurally perceptible sounds, or the reverse, by means of the interaction of a vibrating cone or diaphragm with an electromagnetic or piezoelectric element. Examples of drivers include the typical electromagnetic loudspeakers used in consumer electronic products. The present invention will be described by reference to electromagnetic drivers, but it should be understood that the invention may be practiced using other types of drivers, such as piezoelectric drivers. A driver typically has a positive and a negative terminal, the designated polarity of the terminals being defined by the direction in which the cone of the driver will move in response to a D.C. voltage of a given polarity applied to the terminals.

Each channel loudspeaker 22 and 24 incorporates at least one electrically activated driver responsive to low frequency range electrical signals to produce low frequency sounds, referred to herein as a "woofer" 26 and 28, and may incorporate one or a plurality of other electrically actuated drivers responsive to other frequency ranges. Each channel loudspeaker 22 and 24 also incorporates at least one sonically actuated driver, referred to herein as a "sonic driver" 30, 32. Each woofer 26 and 28 is electrically connected to the corresponding channel of the amplifier (not shown) and produces low frequency sound in response to electrical signals produced by the amplifier. The corresponding sonic drivers 30 and 32 respond to the sound produced by the woofers 26 and 28 to vibrate sympathetically, producing an additional low frequency sound and an electrical signal substantially directly related to the sound produced by the woofer 26 and 28 and indirectly related to the electrical signals received from the amplifier.

A feedback control loudspeaker 34 is located midway between the left and right channel loudspeakers 22 and 24. The feedback control loudspeaker 34 includes four feedback drivers 36, 38, 40, 42 which are sonically interconnected through a feedback duct 44 of the feedback control loudspeaker 34.

Figure 2:
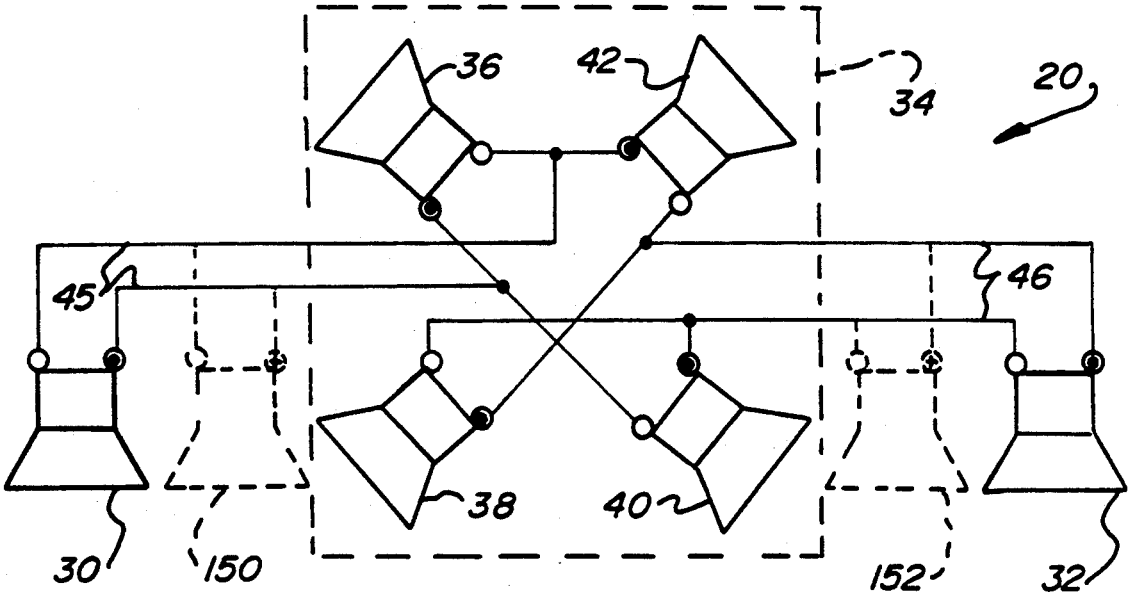
FIG. 2 is an electrical schematic of the electrical interconnection of the channel loudspeakers and the feedback loudspeaker shown in FIG. 1.

Referring to FIG. 2, the four feedback drivers 36, 38, 40 and 42 are electrically connected to the sonic drivers 30, and 32 and are interconnected to each other in a network. In FIG. 2 the terminals of the sonic drivers 30 and 32 and the feedback drivers 36, 38, 40 and 42 are denoted by circles, darkened circles representing positive terminals and open circles representing negative terminals. The four feedback drivers 36, 38, 40 and 42 are interconnected in series with each other. The positive terminal of an upper left feedback driver 36 is connected to the negative terminal of a lower right feedback driver 40. The positive terminal of the lower left feedback driver 40 is connected to the negative terminal of a lower left feedback driver 38. The positive terminal of the lower right feedback driver 38 is connected to the negative terminal of an upper right feedback driver 42. The positive terminal of the upper right feedback driver 42 is connected to the negative terminal of the upper left feedback driver 36.

The left sonic driver 30 is connected in parallel with the upper left feedback driver 36, the positive terminal of the left sonic driver 30 being connected to the positive terminal of the upper left feedback driver 36 and the negative terminal of the lower right feedback driver 40 and the negative terminal of the left sonic driver 30 being connected to the negative terminal of the upper left feedback driver 36 and the positive terminal of the upper right feedback driver 42. Similarly, the right sonic driver 32 is connected in parallel with the lower right feedback driver 38, the positive terminal of the right sonic driver 32 being connected to the positive terminal of the lower left feedback driver 38 and the negative terminal of the upper right feedback driver 42, and the negative terminal of the upper right feedback driver 32 being connected to the negative terminal of the lower left feedback driver 38 and the positive terminal of the lower right feedback driver 40. Movement of the sonic drivers 30 and 32, under the influence of sound and sonic vibration produced in the enclosures of the channel loudspeakers 22 and 24 by the woofers 26 and 28 will cause the cones or diaphragms of the sonic drivers 30 and 32 to move. When the cones or diaphragms of the sonic drivers 30 and 32 move the drivers 30 and 32 produce electrical signals which are conducted along conductors 45 and 46 to the feedback control loudspeaker 34. A downward movement on the right sonic driver 32 principally causes an upward movement of the upper left and lower right feedback drivers 36 and 40. An upward movement principally causes a downward movement of the upper left and lower right drivers 36 and 40. Correspondingly, a downward movement of the left sonic driver 30 principally causes an upward movement of the lower left and upper right sonic drivers 38 and 42, while an upward movement on the left driver 30 causes a downward movement.

It is important to understand that all of the feedback drivers 36, 38, 40 and 42 are electrically and 10 sonically interconnected so that any movement in one causes some movement in the others. The foregoing is a description of the principal movements only. The effect produced in the present invention is that both of the sonic drivers 30 and 32 and feedback drivers 36, 38, 40 and 42 act in response to the others to produce a more pleasing sound.

The left channel loudspeaker 22 will be described in more detail by reference to FIGS. 3-10. It should be understood that the right channel loudspeaker 24 (FIG. 1) is a mirror image of the left channel loudspeaker 22. The mirror image arrangement between a pair of channel loudspeakers 22 and 24 aids in the ability of the entire system to resolve the stereophonic electrical signals produced by the amplifier.

The channel loudspeaker 22 includes a cabinet 50 supported at a predetermined height above a reflective base plate 52 by a pair of supports 54. The cabinet 50 has a box-like configuration made up of a top panel 56, a bottom panel 58 parallel to the top panel 56, two side panels 60 parallel to each other and adjoining and perpendicular to the top and bottom panels 56 and 58 and one back panel 62 adjoining and perpendicular to the top, bottom and side panels 56, 58 and 60. A front panel 64 adjoins the side panels 60 perpendicularly and adjoins the top panel 56 at an obtuse angle and the bottom panel 58 at an acute angle such that the front panel 64 is slightly sloped. In the preferred embodiment the front panel 64 is sloped at a predetermined angle of approximately seven to eight degrees from vertical, the top of the front panel 64 being closer to the back panel 62 than is the bottom of the front panel 64. The cabinet 50 includes a plurality of openings 66, 68 and 70 into which various drivers of the channel loudspeaker 22 (FIG. 1) are installed, and through which the drivers project. A plurality of decorative grilles or baffles 72 are mounted to the cabinet 50 to cover and protect the drivers.

The supports 54 projecting above the base plate 52 each include a tubular threaded upright 74 which passes through a corresponding hole 75 in the bottom panel 58. One of the uprights 74 act as a conduit for conductors 76 which connect the channel loudspeaker 22 to the amplifier (not shown) by way of an input jack 78. Another one of the uprights 74 acts as a conduit for the conductors 45 that connect the channel loudspeaker 22 to the feedback control loudspeaker 34 by way of an output jack 80.

The woofer 26 is mounted in the hole 68 formed therefor in the front panel 64 and the sonic driver 30 is mounted in a hole 70 formed therefor in the bottom panel 58. It should be appreciated that additional high frequency drivers referred to herein as "tweeters" 82, mid-range drivers (not shown), and multiple speaker arrangements known in the art may be incorporated into the channel loudspeaker 22 in a conventional manner.

The woofer 26, sonic driver 30, tweeter 82 and other drivers (not shown) are mounted in the cabinet 50 so that the electromagnets of each driver are approximately aligned in a vertical plane with the electromagnet of each other driver to promote in-phase operation of the drivers. The predetermined angle of the front panel 64 is selected to facilitate the aligned relationship of the drivers and to direct sound produced by the woofer 26 at a slight upward angle towards the listener, reducing the effects of reflections from the surface the loudspeakers are set upon.

A vent 84 defined by a tube 86 passes from a bass range enclosure volume 88 of the cabinet 50, through the front panel 64 to the ambient air 90. The woofer 26 and sonic driver 30 are mounted in the bass enclosure 88. The vent 64 provides air flow communication between the bass enclosure 88 and the ambient air 90. The tube 86 extends through the front panel 64 at a right angle thereto. The tube 86 and vent 84 are thus aligned directionally along a longitudinal axis parallel to that of the woofer 30, exiting the front panel 64 at an angle of seven or eight degrees from horizontal.

The sonic driver 30 is mounted within the bass enclosure 88 of the cabinet 50 above and generally parallel to the base plate 52 and intermediate the supports 54. Screws or other fastening means (not shown) secure a mounting flange 92 of a cone basket 94 of the sonic driver 30 to the bottom panel 58. An electromagnet 96 or piezoelectric element (not shown) of the sonic driver 30 is thus suspended within the cabinet 50 at a position close to and directly behind an electromagnet 98 or piezoelectric element (not shown) of the woofer 26. A cone 99 of the sonic driver 30 is free to move sympathetically under the influence of sound and sonic vibrations generated by the woofer 26 within the bass enclosure 68 of the cabinet 50.

Sound generated by the sympathetic movement of the cone 99 of the sonic driver 30 in response to the woofer 26 is disbursed away from the loudspeaker 22 by the reflective base plate 52. The predetermined height of the cabinet 50 above the bass plate 52 is a factor of 1.4444 times an effective diameter of the sonic driver 30. The effective diameter of the sonic driver 30 is measured across the cone 99 of the driver. If more than one sonic driver 30 is used, the effective diameter of the combination of sonic drivers 30, measured across the combination, is multiplied by 1.4444. This height has been determined to best interrelate the sonic output of the sonic driver 30 to the sound produced in the rest of the system 20 (FIG. 1) and has been found to reduce the effects of the space in which the loudspeaker system 20 is used on the pleasing sound produced by the loudspeaker system 20.

In prior art systems, tubes or vents are sized and tuned to maximize bass response. In the channel loudspeaker 20 of the present invention, the tube 86 and vent 84 are sized and tuned near the middle of the range of the woofer 26 to project the higher frequency sounds created in the bass enclosure 88 by the woofer 26 and sonic driver 30 to the listener. Prior art speakers seek to dampen these higher frequencies using fiberglass packing and the like. The loudspeaker system 20 of the present invention interrelates and uses, to the greatest extent possible, all electrical and sonic information produced by the various components of the system, including these higher frequency sounds created by the woofer 26 and sonic driver 30.

A mass or second enclosure 100 of predetermined size and density is formed within the base enclosure 88 of the cabinet 50 where a mid-range enclosure (not shown) and mid-range driver (not shown) would be located in a typical 3-way loudspeaker system. The tube 86 passes through the mass 100. In a 3-way loudspeaker system incorporating the invention, the tube 86 will pass through the mid-range enclosure. The physical sonic vibrations of the mid-range speaker and the sound waves in the tube 86, which are passed from the woofer 26 and sonic driver 30, will influence each other to create a more pleasing sound.

The woofer 26 is an electrosonic transducer, electrically connected by conductors 76 in a conventional manner to the amplifier (not shown). A frequency crossover network 102 is mounted within the bass enclosure 88. The crossover network 102 is a conventional passive crossover network used to direct electrical signals representative of low frequency sounds to the woofer 26 and to direct electrical signals representative of higher frequency sounds to the tweeter 82. In a three-way loudspeaker the cross-over network would further direct electrical signals representative of middle frequency sounds to a mid-range driver (not shown). The crossover network 102 is of conventional design and connection, including resistors 104, capacitors 106 and inductors 108.

The sonic driver 30 is identical in size, shape, configuration and performance specification to the woofer 26. The sonic driver 30 is not connected to the amplifier, but rather the cone 99 of the sonic driver moves under the influence of sound and sonic vibrations generated in the bass enclosure 88 by the woofer 26. The movement of the cone 99 of the sonic driver 30 causes the electromagnetic element 96 or piezoelectric element (not shown) of the sonic driver 30 to generate an electrical signal related to the movement of the cone 99.

A sonic oscillator is thus formed by the interrelationship between the woofer 26, sonic driver 30 and enclosure 50. The interrelationship between the woofer 26, sonic driver 30 and other components is accomplished by a combination of electrical and sonic interconnections. Sound and sonic vibrations produced by the woofer 26 in response to electrical signals from the amplifier are transmitted through a variety of complex pathways. The principal pathways are through air in the bass enclosure 88 which provides a direct coupling of the cones of the woofer 26 and sonic driver 30. Other pathways important to the production of pleasing sound is through the panels 56, 58, 60, 62 and 64 of the enclosure 50. These vibrate sonically in response to the vibration of the woofer 26 and transmit these vibrations as sound to the ambient air 90 and through the cone basket 94 and frame 92 of the sonic driver 30 to the sonic driver. To a lesser, but still important, extent the vibration of the cone 90 of the sonic driver 30 influences the vibration of air in the bass enclosure 88, the panels 56, 58, 60 and 62 of the enclosure 50 and the woofer 26. The material from which the panels 56, 58, 60 and 62 are formed affects the pleasing qualities of the sound produced, woods being used in the preferred embodiment.

The tube 86 sonically connects the bass enclosure to the ambient air 90 outside the loudspeaker 22, through the mass 100 or mid-range enclosure (not shown). The tube 86 is sized, and therefore tuned, to the woofer 26 and sonic driver 30 by reference to their resonant free air frequency. In an alternative preferred embodiment, not shown, the cones and electromagnetic or piezoelectric elements of the woofer and sonic driver are mounted coaxially in a single cone basket. The cone frame is then mounted to a panel of an enclosure.

Figure 11:
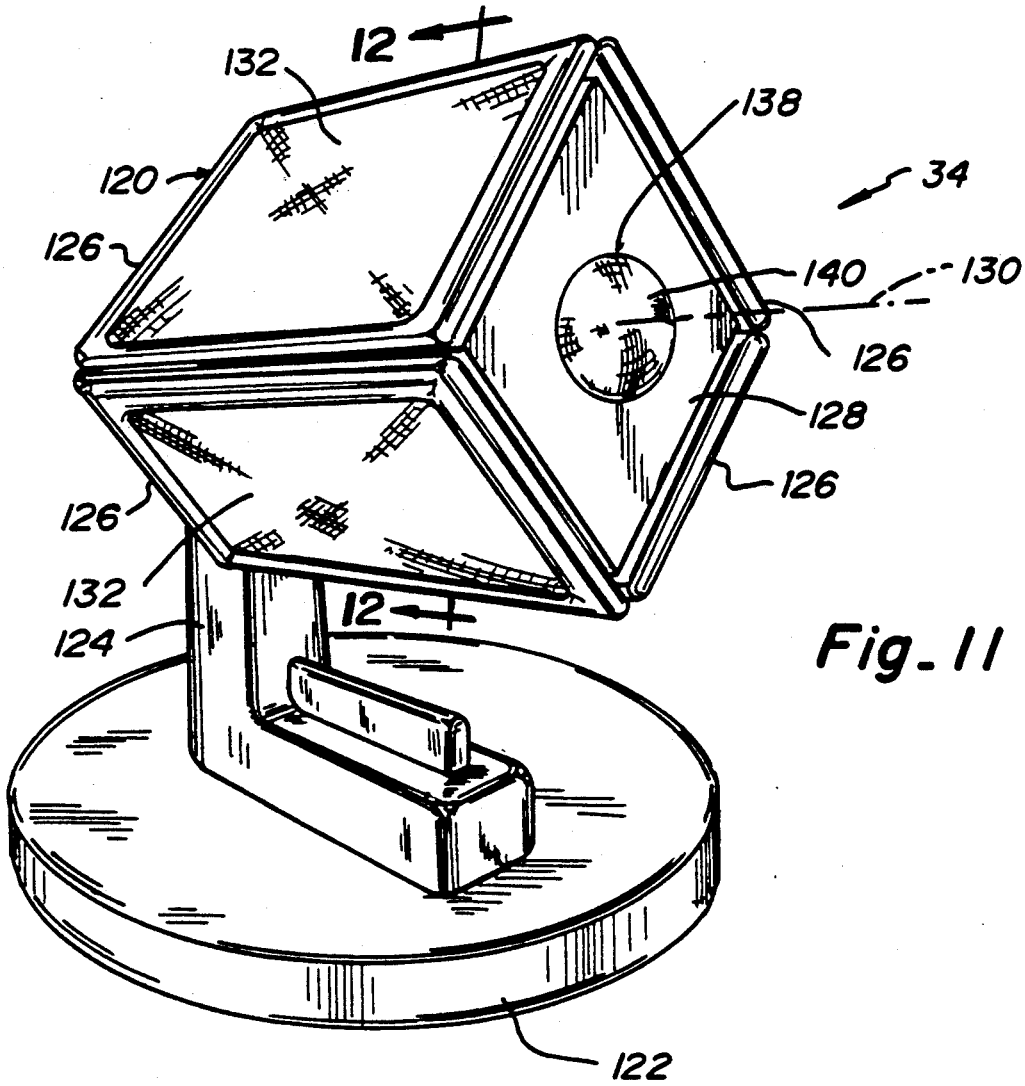
FIG. 11 is a perspective view of the feedback loudspeaker shown in FIG. 1.
Figure 12:
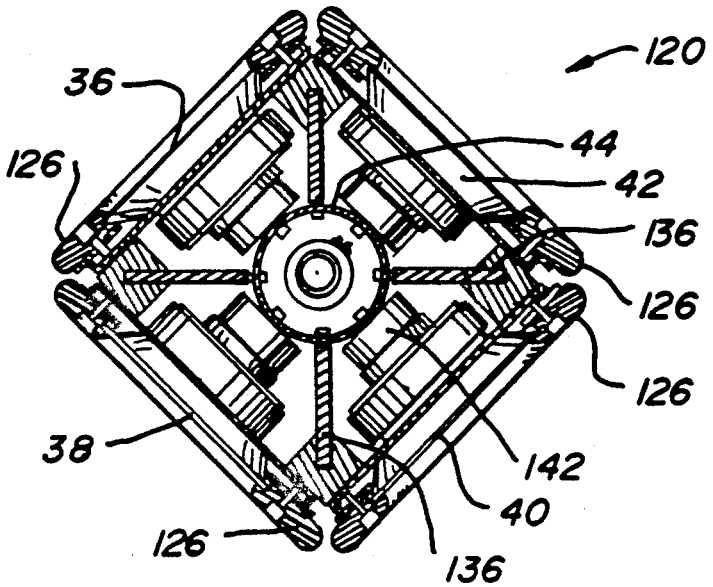
FIG. 12 is a fragmentary sectional view of the feedback loudspeaker taken along line 12—12 of FIG. 11.

The feedback control loudspeaker 34 will be described in more detail by reference to FIGS. 11 and 12. The feedback control loudspeaker 34 comprises a speaker enclosure 120 supported from a base 122 by a support pedestal 124. The enclosure 120 has a rectangular configuration having sides defined by four feedback driver mounting frames 126 and a first end defined by a front panel 128. A second end of the enclosure 120 is formed by a back panel (not shown) which is similar in size and shape to the front panel 128 and which is connected to the support pedestal 124 in a conventional way to support the enclosure 120 at a height above the base 122. A longitudinal axis 130 of the enclosure 120 is perpendicular to the front panel 128, parallel to the four mounting frames 126 and equidistant from each of the four mounting frames 126. The enclosure 120 is oriented so that the mounting frames 126 are each at approximately forty five degree angles to a plane defined by the base 122 and so that the longitudinal axis 130 is seven to eight degrees above horizontal, placing the front panel at the same angle from vertical as the front panels 64 (FIG. 9) of the channel loudspeakers 22 and 24 (FIG. 1).

One of the feedback drivers 36, 38, 40, and 42 is mounted to each one of the mounting frames 126. A protective grille or front baffle 132 covers and protects each feedback driver 36, 38, 40 and 42. The feedback drivers 36, 38, 40, and 42 are each preferably matched to the woofers 26 and 28 (FIG. 1) and the sonic drivers 30 and 32 (FIG. 1), that is they are all of the same size, shape, configuration and performance specification. The four feedback drivers 36, 38, 40, 42 are radially oriented about the longitudinal axis 130 at equal arcuate distances about the central tube or duct 44. The duct 44 is held in a coaxial relationship with the longitudinal axis 130 of the enclosure 120 by a plurality of positioning dowels 136. In the preferred embodiment the duct 44 is selected to have the same characteristic frequency as the vent tubes 86 (FIG. 9) of the channel loudspeakers 22 and 24 (FIG. 1). The duct 44 is passed through a duct hole 138 in the front panel 128 and is glued or otherwise connected to the front panel 128. A protective grille or baffle 140 covers the duct hole 138. The electromagnets 142 or piezoelectric elements (not shown) of the feedback drivers 36, 38, 40, and 42 abut the duct 44 and are in direct physical contact with the duct 44. In a manner similar to the vent tube 86 (FIG. 9), the duct 44 physically and sonically interrelates the sound output of the various feedback drivers 36, 38, 40, and 42 by reason of the physical contact that is shared by the electromagnets 142 touching the duct 44. As explained above, the drivers 36, 38, 40, and 42 are also electrically interconnected with each other and with the sonic drivers 30 and 32 of the channel loudspeakers 22 and 24 (FIG. 1).

The feedback control loudspeaker 34 receives the electrical signals generated by the physical movement of cones 99 (FIG. 9) and electromagnets 96 (FIG. 9) of the sonic drivers 30 and 32 (FIG. 1). The feedback control loudspeaker 34 interrelates the electrical signals electrically through the interconnection of the speakers and physically and sonically through the physical contact of the electromagnets 142 of the feedback drivers 36, 38, 40 and 42 with the duct 44 in a predetermined fashion. The end result is that both the electrical signal output from the amplifier and the sonic energy generated by it are interrelated and blended together. For reasons not completely understood, this blending and interrelationship has the effect of enhancing the pleasing qualities of the bass sound produced by the loudspeaker system 20 (FIG. 1).

The use of the loudspeaker system 20 of the present invention is explained by reference to FIGS. 1 and 2. The feedback control loudspeaker 34 is installed in a centered location between the channel loudspeaker 22 and 24. It has also been determined that best results are achieved by keeping the length of the conductors 45 from the left sonic driver 30 to the feedback control loudspeaker 34 equal in length to the conductors 46 between the right sonic driver 32 and the feedback control loudspeaker 34. It is further preferable to align the front panels 64 (FIG. 9) of the channel loudspeaker 22 and 24 and the front panel 128 (FIG. 11) of the feedback control loudspeaker 34 in a co-planar relationship.

Additional channel loudspeakers (not shown) may be added to the system by parallel connection to those already shown. These added channel loudspeakers should be positioned closer to the center feedback control loudspeaker 34 than the channel loudspeakers 22 and 24. Sonic drivers 150, 152 of the added speakers are conductively connected to the conductors 45 and 46, respectively, in parallel with the respective sonic drivers 30, 32 of the channel loudspeakers 22, 24. No matter what the arrangement, the feedback control loudspeaker 34 is preferably physically centered with respect to the channel loudspeakers 22 and 24 and any added loudspeakers.

Figure 9:
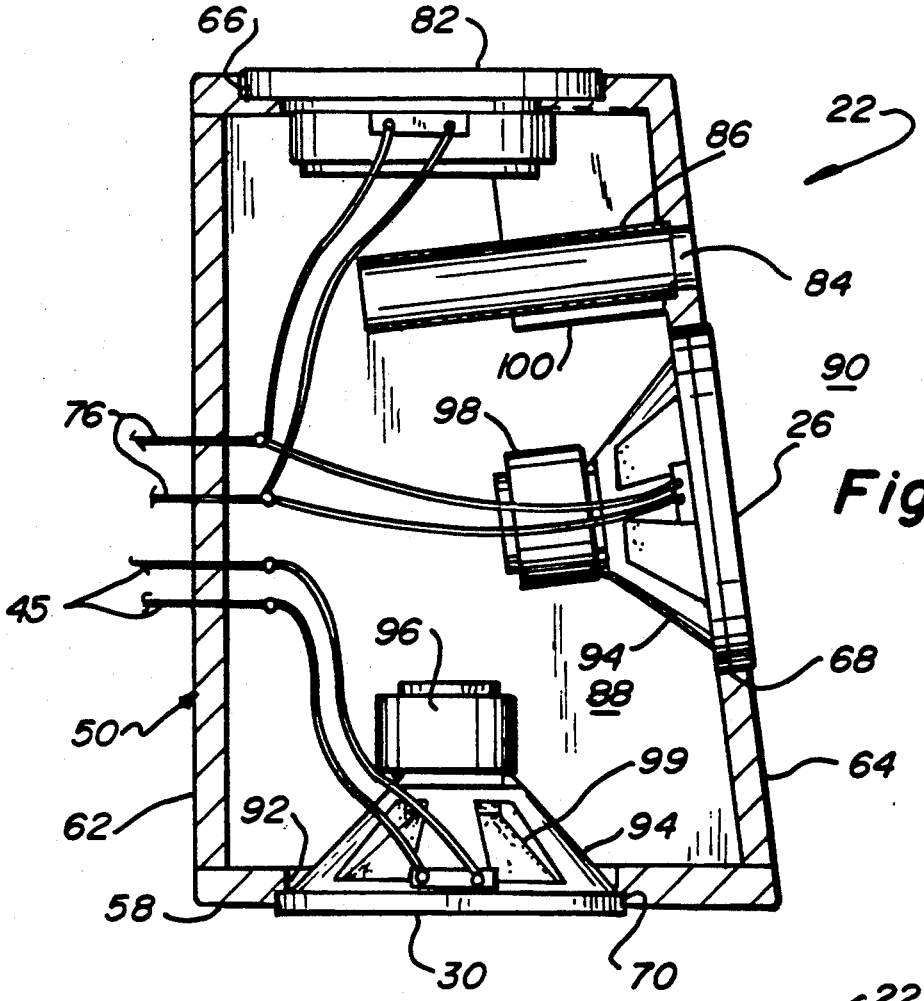
FIG. 9 is a fragmentary sectional view of the channel loudspeaker taken along line 9—9 in FIG. 3.
Figure 10:
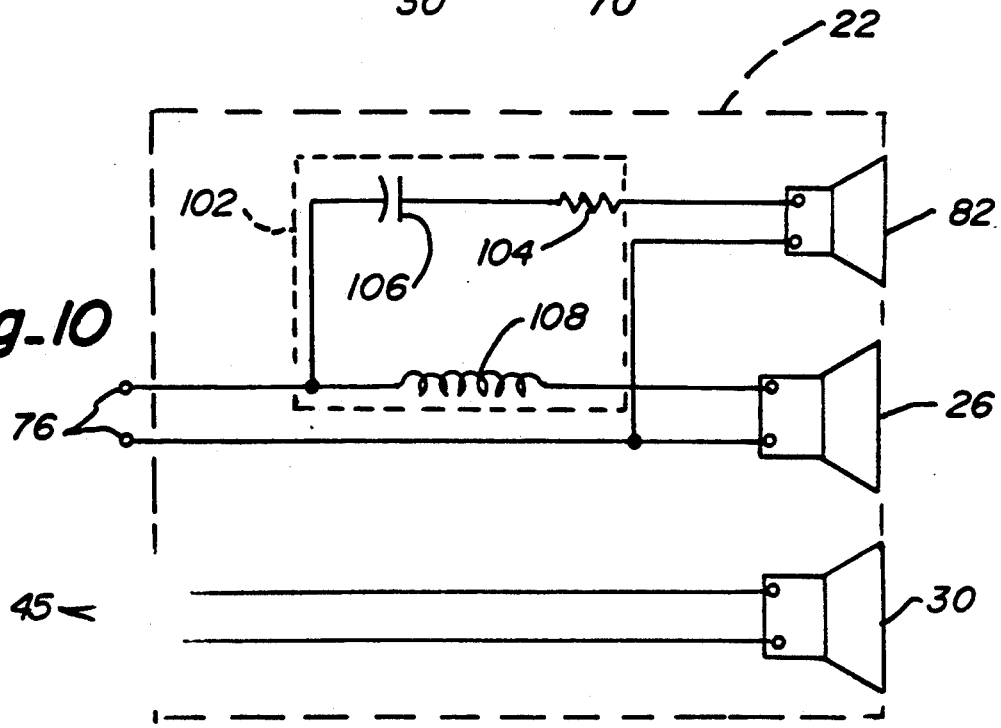
FIG. 10 is an electrical schematic of the wiring connection for the channel loudspeaker shown in FIG. 1.

In operation, the output of the amplifier (not shown) is directed to the channel loudspeakers 22 and 24 in a well-known manner. The electrical signal is divided by the crossover network 102 (FIG. 10) between the woofer 26 and the tweeter 82. Sonic energy produced by the woofers 26 and 28 in the bass enclosure 88 (FIG. 9) cause the cones 90 (FIG. 9) of the sonic drivers 30 and 32 to move and the tubes 86 (FIG. 9) to resonate at frequencies that are produced by the woofers 26 and 28 and sonic drivers 30 and 32. The frequencies produced in the bass enclosures 88 (FIG. 9) include higher frequencies which are normally damped out in prior art devices. These frequencies are directed to the listener along the tubes 86 (FIG. 9). These frequencies can also be interrelated with a mid-range driver (not shown) as the tube 86 passes through a mid-range enclosure (not shown).

As the sonic drivers 30 and 32 move under the influence of the sonic output of the woofers 26 and 28, small electrical signals are produced. The signals produced are electrically conducted by conductors 45 and 46 to the feedback drivers 36, 38, 40 and 42 of the feedback control loudspeaker 34, causing them to move in response. Movement of the feedback drivers 36, 38, 40 and 42 generates reverse voltages which electrically influence the sonic drivers 30 and 32, which in turn sonically influence the woofers 26 and 28. The effect is a complex electrical and sonic interrelationship among all of the woofers 26 and 28, sonic drivers 30 and 32 and feedback drivers 36, 38, 40 and 42. For reasons not completely understood, to the listener of the loudspeaker system 20 this effect translates into sound reproduction having a very pleasing and realistic quality.

While the invention has been shown with a certain degree of particularity, the scope of the invention is as defined in the appended claims.

We claim:

1. A loudspeaker system for receiving a plurality of input electrical signals representative of sounds to be reproduced from a source of the input electrical signals and for converting the input electrical signals into sound, comprising:

a first channel loudspeaker operative to convert a first input electrical signal into a first sound and further operative to produce a first output electrical signal related to the first input electrical signal;

a second channel loudspeaker operative to convert a second input electrical signal into a second sound and further operative to produce a second output electrical signal related to the second input electrical signal; and a feedback control loudspeaker electrically connected to the first and the second channel loudspeakers, receptive of the first and second output electrical signals and operative to convert the first and second output electrical signals into sound.

2. A loudspeaker system as defined in claim 1 wherein each channel loudspeaker further comprises: at least one electrical driver responsive to the corresponding input electrical signal to produce the sound; and at least one sonic driver responsive to the sound produced by the electrical drivers of the channel loudspeaker to produce an electrical signal related to the sound.

3. A loudspeaker system as defined in claim 2 wherein the feedback control loudspeaker further comprises:

at least one feedback driver responsive to the first and second output electrical signals to produce a sound related to the first and second output signals.

4. A loudspeaker system as defined in claim 2 wherein the feedback control loudspeaker comprises:

a tubular feedback duct having a longitudinal axis and a mouth at an end of the feedback duct; and a plurality of feedback drivers radially oriented about the longitudinal axis of the feedback duct.

5. A loudspeaker system as defined in claim 4 wherein:

the plurality of feedback drivers comprises four feedback drivers; and the feedback control loudspeaker further comprises:

a feedback enclosure comprising:

four rectangular mounting frames, each mounting frame having a first edge, an opposite second edge, a rear edge, and an opposite front edge and having an interior side and an exterior side, the first edge of each one of the mounting frames being perpendicularly joined to the second edge of an adjacent one of the mounting frames to form the feedback enclosure in a rectangular prismatic configuration with the exterior side of each mounting frame forming an exterior surface of the feedback enclosure;

a rectangular rear panel perpendicularly joined to the rear edge of each of the mounting frames; and a rectangular front panel having two diagonal axes perpendicularly joined to the front edge of each of the mounting frames; and wherein:

each feedback driver is attached to the interior side of a corresponding one of the mounting frames.

6. A loudspeaker system as defined in claim 5 further comprising:

a feedback enclosure support structure having a base plate, the support structure being rigidly attached to the rear panel of the feedback enclosure; and wherein:

the feedback enclosure is supported in a suspended configuration at a predetermined height above the base plate by the feedback enclosure support structure.

7. A loudspeaker system as defined in claim 5 wherein:

the one of the diagonal axes of the front panel of the feedback enclosure is substantially horizontal.

8. A loudspeaker system as defined in claim 5 wherein:

the front panel of the feedback enclosure defines a duct opening located substantially at the center of the front panel; and the mouth of the feedback duct is open to the exterior of the feedback enclosure through the feedback duct opening.

9. A loudspeaker system as defined in claim 8 wherein:

the longitudinal axis of the feedback duct is perpendicular to both of the diagonal axes of the front panel; and the longitudinal axis of the feedback duct is oriented at an angle of between 6° and 10° from horizontal.

10. A loudspeaker system as defined in claim 4 wherein:

each feedback driver has a actuating element; and each actuating element is in direct physical contact with the feedback duct.

11. A loudspeaker system as defined in claim 4 wherein:

the feedback drivers are electrically interconnected in a series circuit; and each one of the sonic drivers of the channel loudspeakers is electrically connected in parallel with a preselected one of the feedback drivers.

12. A loudspeaker system as defined in claim 11 wherein:

the plurality of feedback drivers comprises a first, a second, a third and a fourth feedback drivers, electrically interconnected in series with the first feedback driver connected to the fourth and the second feedback drivers, the second feedback driver connected to the third feedback driver and the third feedback driver connected to the fourth feedback driver.

13. A loudspeaker system as defined in claim 12 wherein;

one of the sonic driver is electrically connected in parallel with the first feedback driver; and another one of the sonic drivers is electrically connected in parallel with the third feedback driver.

14. A loudspeaker system as defined in claim 4 wherein;

the sonic drivers comprise a first and a second sonic driver each having a sonic driver cone;

the plurality of feedback drivers comprises four feedback drivers each having a feedback driver cone and oriented with two of the feedback drivers positioned to project sound in a generally upward direction and two of the loudspeakers positioned to project sound in a generally downward direction;

the sonic drivers of the channel loudspeakers and the feedback drivers of the feedback control loudspeaker are electrically interconnected;

the feedback drivers of feedback control loudspeaker are physically and sonically interconnected through the feedback duct;

the electrical, sonic and physical interconnections operative interrelate the motion of the sonic driver cones and the feedback driver cones to principally move the cones of two of the four feedback drivers in the upward direction in response to movement of the cone of the first sonic driver in a first direction, to principally move the cones of the two of the four feedback drivers in the downward direction in response to movement of the cone of the first sonic driver in a second direction opposite to the first direction, to principally move the cones of another two of the four feedback drivers in the upward direction in response to movement of the cone of the second sonic driver in the first direction, and to principally move the cones of the other two of the four feedback drivers in the downward direction in response to movement of the cone of the second sonic driver in the second direction.

15. A loudspeaker system as defined in claim 14 wherein:

one of the two feedback drivers which respond principally to movement of the cone of the first sonic driver is oriented to project sound generally in the upward direction;

another one of the two feedback drivers which respond principally to movement of the cone of the first sonic driver is oriented to project sound generally in the downward direction;

one of the other two feedback drivers which respond principally to movement of the cone of the second sonic driver is oriented to project sound generally in the upward direction; and another one of the other two feedback drivers which respond principally to movement of the cone of the second sonic driver is oriented to project sound generally in the downward direction.

16. A loudspeaker system as defined in claim 1 wherein each channel loudspeaker further comprises:

a first sound enclosure containing at least one electrical driver arranged to project sound outwardly from, and mounted in an air sealed relationship with, the first sound enclosure; and at least one sonic driver in the first enclosure mounted in an air sealed relationship within the first sound enclosure and arranged to project sound outwardly from the first sound enclosure.

17. A loudspeaker system as defined in claim 16 wherein each channel loudspeaker further comprises:

a second sound enclosure relatively smaller than the first sound enclosure contained by and located within the first sound enclosure;

an elongated tubular vent passing through the second enclosure the vent having a first mouth within the first sound enclosure and a second mouth at an exterior surface of the first sound enclosure, the vent tuned to resonate at generally the middle of the frequency range of one of the electrical driver or the sonic driver.

18. A loudspeaker system as defined in claim 17 wherein:

each first sound enclosure is defined by a structure comprising a bottom panel, a top panel, a back panel, two side panels, and a front panel; and and each second sound enclosure is defined by a separate structure affixed within the interior of the first sound enclosure.

19. A loudspeaker system as defined in claim 18 wherein each channel loudspeaker further comprises:

a base plate; and a support structure rigidly attached to the base plate; and wherein:

the first sound enclosure is rigidly attached to the support structure and is supported by the support structure at a predetermined height above the base plate by the support structure, the first sound enclosure being oriented with the bottom panel of the first sound enclosure in a generally parallel relationship with the base plate.

20. A loudspeaker system as defined in claim 19 wherein:

each electrical driver is located in a corresponding opening formed in the front wall of a corresponding one of the channel loudspeakers; and each sonic driver is located in an opening formed in the bottom panel of a corresponding one of the channel loudspeakers, the sonic drivers being oriented to project sound downward against the base plate.

21. A loudspeaker system as defined in claim 20 wherein:

each base plate is sonically reflective and is operative to reflect sound produced by the sonic drivers of a corresponding one of the channel loudspeakers.

22. A loudspeaker system as defined in claim 21 wherein:

the predetermined height is between 1.4 and 1.5 times the effective diameter of the sonic driver.

23. A loudspeaker system as defined in claim 19 wherein the front panel forms an acute included angle with respect to the bottom panel and said included angle subtends an arc of approximately 80° to 84°.

24. A loudspeaker system as defined in claim 23 wherein:

the second mouth of the tubular vent is located in an opening formed in the front wall to project a sound product of the vent into the same plane as the sound produced by the electrical driver.

25. A loudspeaker system as defined in claim 17 wherein:

the second sound enclosure comprises a solid mass within the first sound enclosure; and the tubular vent passes through the second enclosure.

26. The loudspeaker system invention as defined in claim 1 wherein:

the feedback control loudspeaker is adapted to be centered between the first and second channel loudspeakers.

27. The loudspeaker system as defined in claim 26 wherein:

the loudspeaker system is adapted for use with a third and a fourth channel loudspeakers by electrically connecting the third channel loudspeaker in parallel with the first channel loudspeaker, positioning the third channel loudspeaker between the first channel loudspeaker and the feedback control loudspeaker, electrically connecting the fourth channel loudspeaker in parallel with the second channel loudspeaker, and positioning the fourth channel loudspeaker between the second channel loudspeaker and the feedback control loudspeaker.

28. In a loudspeaker system having a first sound enclosure containing at least one electrical driver arranged to project sound outwardly from, and mounted in an air sealed relationship with, said first sound enclosure;

at least one sonic driver in said first enclosure mounts in an air sealed relationship with, and is arranged to project sound outwardly from said first enclosure;

an enclosure relatively smaller than the first sound enclosure contained by and located within the first sound enclosure is passed through by an elongated tubular vent having a first mouth within the first sound enclosure and a second mouth at an exterior surface of the first sound enclosure, the vent being tuned to resonate at generally the middle of the free air resonant frequency range of one of the electrical or of the first sonic drivers;

the first sound enclosure is defined by a structure comprising a bottom panel, a back panel, two side panels, and a front panel, and the second sound enclosure is defined by a separate structure affixed within the interior of the first sound enclosure;

the first sound enclosure is rigidly attached to a support structure and is supported thereby at a predetermined and fixed height above a baseplate which is rigidly attached to the support structure, the first sound enclosure being oriented by this arrangement with its bottom panel in a generally parallel relationship with the baseplate; and each electrical driver is located in a corresponding opening formed in the front panel and the sonic driver is located in an opening formed in the bottom panel, the sonic driver being oriented to project sound downward against the baseplate.

29. A loudspeaker system as defined in claim 28 wherein the baseplate is sonically reflective and is operative to reflect to sound produced by the sonic driver.

30. A loudspeaker system as defined in claim 29 wherein the predetermined height is between 1.4 and 1.5 times the effective diameter of the sonic driver.

31. A sonic oscillator apparatus comprising:

a frame structure;

primary electro-acoustic transducer means operative for converting varying input electric signals from an amplifier to sound vibrations, the primary transducer being connected to the frame in a vibrationally transmitting and receiving relationship and being there held in a vibrationally transmitting and receiving relationship with the surrounding air;

secondary sonic transducer means, not connected to an amplifier operative for converting sound vibrations to varying electric output signals while producing thereby related output sound product vibrations, the secondary transducer being connected to the frame structure in a vibrationally receiving and transmitting relationship and being held there in a vibrationally receiving and transmitting relationship with the surrounding air; and at least a third loudspeaker connected to be driven by the varying electric output signals produced by the secondary sonic transducer means.

32. In a loudspeaker system having a first sound enclosure mounting at least one electrical driver responsive to an amplifier in an air sealed relationship with and arranged to project sound outwardly from said first sound enclosure, the improvement comprising:

at least one sonic driver, not connected to an amplifier mounted an air sealed relationship with and arranged to project sound outwardly from the first sound enclosure, generating thereby under vibrational influence of the electric driver against which it is held in a juxtapositional relationship by the physical structure and geometry of the first sound enclosure, an electrical signal output variable in proportion to input signals driving the electric driver; and a frame structure supporting said first sound enclosure, a part of said frame structure physically reflecting a portion of the sound being projected away from the first sound enclosure by the sonic driver directly back into the sound being produced in the interior of the first sound enclosure by the electric driver.

* * * * *